United States Patent [19]

Lewyllie et al.

[11] Patent Number: 4,834,145

[45] Date of Patent: May 30, 1989

[54] APPARATUS AND METHOD FOR CUTTING AN INSERTED WEFT THREAD

[75] Inventors: Dirk Lewyllie, Wervik; Jose Vangheluwe, Ieper, both of Belgium

[73] Assignee: Picanol N.V., Ieper, Belgium

[21] Appl. No.: 163,836

[22] Filed: Mar. 3, 1988

[30] Foreign Application Priority Data

Mar. 9, 1987 [BE] Belgium ..... 08700224

[51] Int. Cl.[4] ..... D03D 49/70

[52] U.S. Cl. ..... 139/429; 139/194; 139/302

[58] Field of Search ..... 139/116, 429–450, 139/194, 302, 291 C, 263, 264, 265, 266, 267, 268, 452

[56] References Cited

U.S. PATENT DOCUMENTS

| | | | |
|---|---|---|---|
| 2,806,487 | 9/1957 | Zapf | 139/302 |
| 3,844,316 | 10/1974 | Palencher | 139/429 |
| 4,134,434 | 1/1979 | Malasek | 139/429 |
| 4,241,767 | 12/1980 | Laddach et al. | 139/429 |
| 4,531,555 | 7/1985 | Tatematsu et al. | 139/429 |
| 4,570,683 | 2/1986 | Griffith | 139/302 |
| 4,586,543 | 5/1986 | Volland et al. | 139/452 |

FOREIGN PATENT DOCUMENTS

| | | |
|---|---|---|
| 271419 | 7/1964 | Netherlands . |
| 6507467 | 6/1965 | Netherlands . |

*Primary Examiner*—Henry S. Jaudon

*Attorney, Agent, or Firm*—Bacon & Thomas

[57] ABSTRACT

A method and apparatus for cutting a weft thread are disclosed in which a completely separate, independent drive system for the weft thread cutter and clamping device enables the cutting time to be optimized without affecting the main drive system for the loom. By using its own, independent drive system, which is completely independent of the main loom drive, the cutter can be actuated at any time during the loom cycle. The cutter and clamp drive system is controlled by a computer, which may be programmed to determine the optimum cutting time as a function of the weaving parameters and the weft thread data. A device may be provided to detect an improperly inserted weft thread. Once this has been detected, the computer may deactivate the cutting device to prevent the separation of the improperly inserted weft thread from the weft thread supply.

20 Claims, 2 Drawing Sheets

APPARATUS AND METHOD FOR CUTTING AN INSERTED WEFT THREAD

BACKGROUND OF THE INVENTION

The present invention relates to an apparatus and a method for cutting an inserted weft thread on a loom wherein the cutter is activated by a drive system that is completely separate from the main loom drive system.

As is well known in the fabric making art, after a length of weft thread has been inserted into the shed, it is severed from the weft thread supply by a cutting device. It is known, as evidenced by U.S. Pat. No. 4,134,434 and 4,531,555, to provide a cutting device which is mechanically driven by means of a cam system or the like from the main drive system of the loom. The cutter is thus driven synchronously with the loom operation.

Since the cutter system is mechanically coupled to the main drive of the loom, the time during the loom cycle that the weft thread is cut from the weft thread supply is fixed relative to the loom cycle. It is well known in the art that the optimal time for cutting a weft thread in relation to the loom cycle depends upon the type of weft thread that is being used. In the known devices, the use of different types of weft thread results in a compromise in the optimal cutting times, since the cutter is mechanically coupled to the loom drive. Thus, the known system render it impossible to optimize the cutting time for each particular type of weft thread.

In many cases, provision must be made for preventing the cutting of the weft thread from the weft thread supply where a weft thread insertion error must be remedied (see Dutch patent application 86 02 191). In these instances, the defectively inserted weft thread should not be severed from the weft thread supply. The insertion of the subsequent weft thread, which is still connected to the defective thread, will remove the defective weft thread from the loom. The known devices either mechanically lock the cutter device or keep the weft thread displaced from the cutter in order to prevent its being severed. The use of a separate device to mechanically lock the cutter or to displace the thread out of the cutter range serves to increase the complexity of the loom system.

SUMMARY OF THE INVENTION

An object of the present invention is to provide a method and apparatus for cutting a weft thread in which cutting time can be optimized for a particular type of weft thread.

It is a further object to provide a method and apparatus in which the cutting device may be deactivated in those instances in which a defective weft thread is detected.

It is a further object of the invention to provide a completely separate, independent drive system for the cutter and clamping device to enable the cutting time to be optimized without affecting the main drive system of the loom. By using its own, independent drive system, which is completely independent of the main loom drive, the cutter can be actuated at any time during the loom cycle. The cutter and clamp drive system is controlled by a computer, which may be programed to determine the optimum cutting time as a function of weaving parameters and weft thread data.

Means may also be provided to detect an improperly inserted weft thread. Once this has been detected, the computer may deactivate the cutting device to prevent the separation of the improperly inserted weft thread from the weft thread supply.

BRIEF DESCRIPTION OF THE DRAWINGS

Further features and advantages of the invention will be found in the description below of the embodiments illustrated in the drawings.

DETAILED DESCRIPTION OF THE PREFERRED EMBODIMENTS

Figure 1:
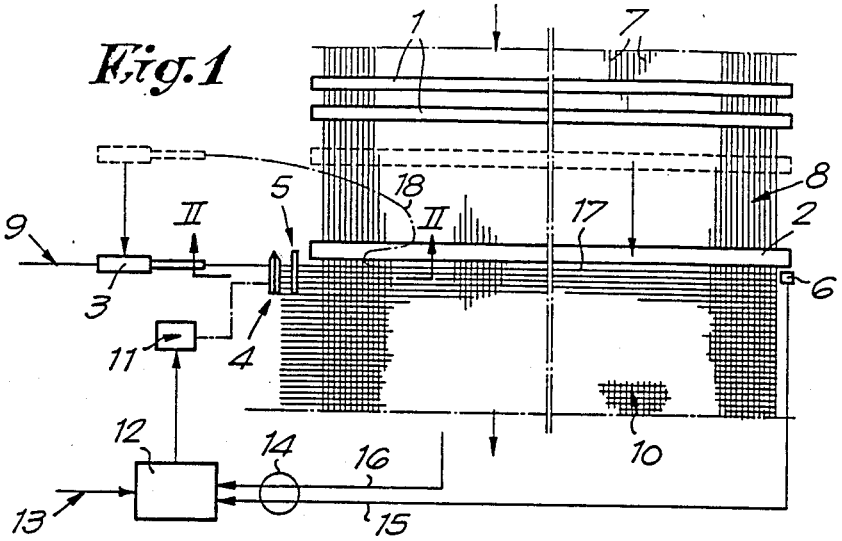
FIG. 1 is a schematc representation of a loom incorporating the cutting device according to the invention.

FIG. 1 is a schematic view of a loom including a heddle 1, a reed (or beat-up) 2, a main weft thread insertion nozzle 3, a weft thread cutting device 4, a weft thread clamping device 5, and a weft thread stop-motion 6. Also shown are warp threads 7, shed 8, the weft thread supply 9, and the finished fabric 10. Following a proper insertion of a weft thread, it will be cut from the weft thread supply exiting through the main weft insertion nozzle 3 by means of weft thread cutter 4. The main loom drive system for driving a heddle 1 and the reed 2 is schematicaly shown at 32.

According to the present invention, the scissors-like cutting device 4 is actuated by cutter drive means 11 that is completely separate from main loom drive 32. The cutter drive means 11 is controlled by computer 12 which has data input means 13, 14, 15 and 16. In accordance with the programmed data, the computer 12 controls the drive means 11, which may be an electrical stepper motor, to optimize the cutting time for each type of weft thread, without being dependent upon the operational cycle of the loom.

The input data at 13 may include: weaving parameters such as data concerning the weaving cycle, from which it is possible to determine the optimum time for activating the cutting device 4; further data concerning the weaving pattern; and data relating to the type of weft thread, thereby enabling the computer to ascertain within one weaving cycle the optimum cutting time for a particular type of weft thread. Input data 13 may also include data concerning the operational characteristics of the loom, including normal operation or the state at thread rupture, the state during startup, slow motion operation, etc. The data 13 may be manually programmed into the computer 12 or may be input to the computer via sensors placed on the loom.

The input data for the computer 12 may also include weft thread data 14, which consists of a signal 5 from the weft thread stop-motion 6 and one or more signals 16 generated by sensors which monitor the course of the weft thread in the shed 8.

As illustrated in FIG. 1, a weft thread 17 is inserted in a conventional manner and, as is well known in the art, is beaten-up by a reed 2. The weft thread is forced, at the pick side, between the jaws of the weft thread clamp 5 which is oridinarily maintained in its clamping position. Thus, the beat-up of the weft thread 17 causes it to be inserted into and clamped by the weft thread clamp 5. At this time the weft thread 17 also enters the cutting device 4.

If the weft thread data 14 indicate that the weft thread insertion has been properly carried out, the computer 12, by means of the supplied waving parameters, will activate the cutter drive 11, thereby causing the cutter 4 to sever the inserted weft thread 17 from the supply 9 emanating from the main weft thread nozzle 3.

However, if a defective weft insertion is ascertained, the computer 12 prevents the cutter drive 11 from activatiing the cutter 4 to enable the defective weft thread to be subsequently removed.

Figure 2:
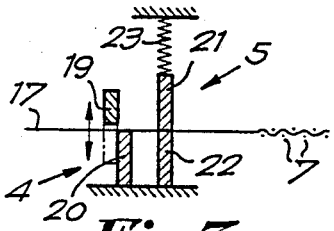
FIG. 2 is a schematic diagram of a cross-section of the cutter and weft thread clamp taken along line II—II in FIG. 1.

The defective weft thread 17 is removed by inserting a new length of weft thread into the shed as indicated by phantom line 18 in FIG. 1. It must be born in mind, however, that even if the weft thread 17 has been found to be defectively inserted, it will have already been beaten-up into the weft thread clamp 5 as shown in detail in FIG. 2. Therefore, when a defective weft thread 17 is to be removed, the weft thread clamp 5 must be temporarily opened. The drive system according to the invention opens the clamp 5 via the cutter drive 11 by interconnecting the clamap 5 with the cutter 4, as will be described in more detail hereinafter.

Figure 3:
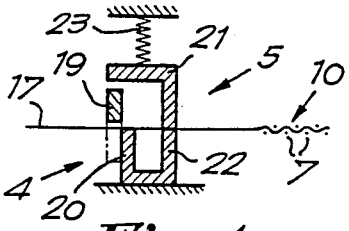
FIG. 3 is a schematic representation of a second embodiment of the cutter and clamp device showing the clamp in its closed position.

FIG. 3 schematically illustrates the combination of the cutter 4 and the weft thread clamp 5. The cutter 4 comprises a stationary cutter portion 20 and a movable cutter portion 19, while clamp 5 comprises a stationary clamping portion 22 and a movable clamping portion 21. Spring 23 serves to bias movable clamping portion 21 into contact with stationary clamping portion 22.

Figure 4:
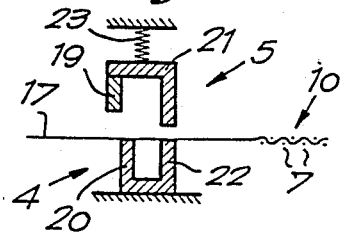
FIG. 4 is a schematic representation of the second embodiment shown in FIG. 3 in which the clamp is positioned in its released position following the detection of a weft thread insertion error.

Cutter drive 11 is designed such that it can move the movable portion 19 of cutter 4 into three positions. A first position in which the movable portion 19 passes across the path of weft thread 17 adjacent to the stationary cutter portion 20 moves to sever the weft thread 17. The second position is schematically illustrated in FIG. 3 wherein the movable cutter portion 19 is displaced from the stationary cutter portion 20, but is not in contact with movable clamping portion 21 such that the clamp 5 remains in its clamped position. The third position is schematically illustrated in FIG. 4. As can be seen, in this third position, the movable cutter portion 19 contacts the movable clamping portion 21 so as to overcome the bias force of spring 23 and displace the movable clamping portion 21 from the stationary clamping portion 22 so as to unclamp the weft thread 17. In this position, a defective weft thread 17 may be easily removed in the manner previously described.

Various combinations of the interrelated operation of the cutter 4 and the clamp 5 may be used without exceeding the scope of this invention. Thus, it is possible that whenever the weft thread 17 is introduced into the shed and before it is beat-up into the clamp 5 by the reed 2, the clamp 5 may be opened by the cutter 4. As a result, the weft thread 17 may be easily introduced between the movable clamping portion 21 and the stationary clamping portion 22. Subsequently, the cutter 4 can be moved into the cutting position such that the weft thread 17 will be clamped between the stationary and movable portions of the clamp 5 before it is severed from the thread supply 9.

Figure 6:
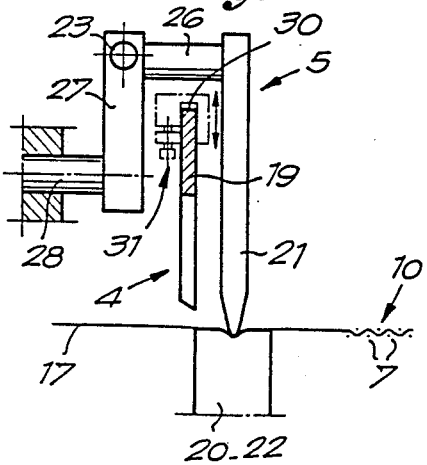
FIG. 6 is a sectional view taken along line VI—VI of FIG. 5.
Figure 5:
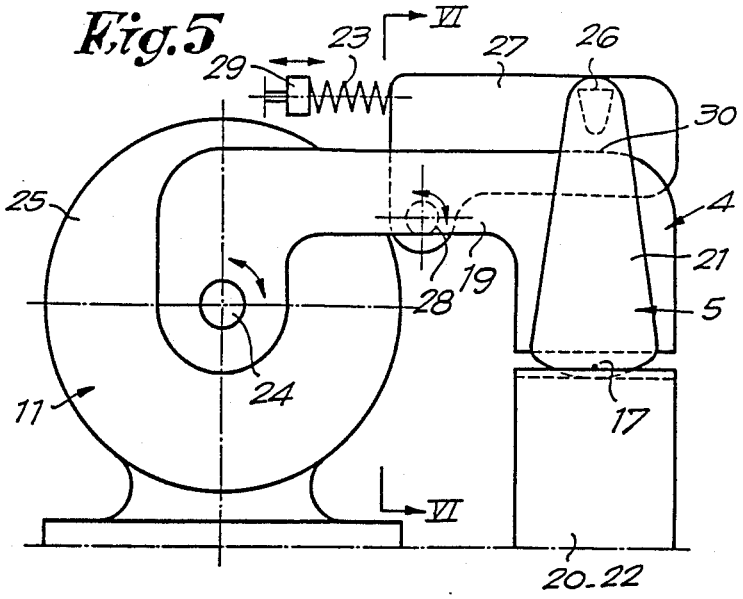
FIG. 5 is a side elevational view of the cutter and weft thread clamp wherein the clamp is in its closed position and the cutter is displaced from the weft thread.
Figure 7:
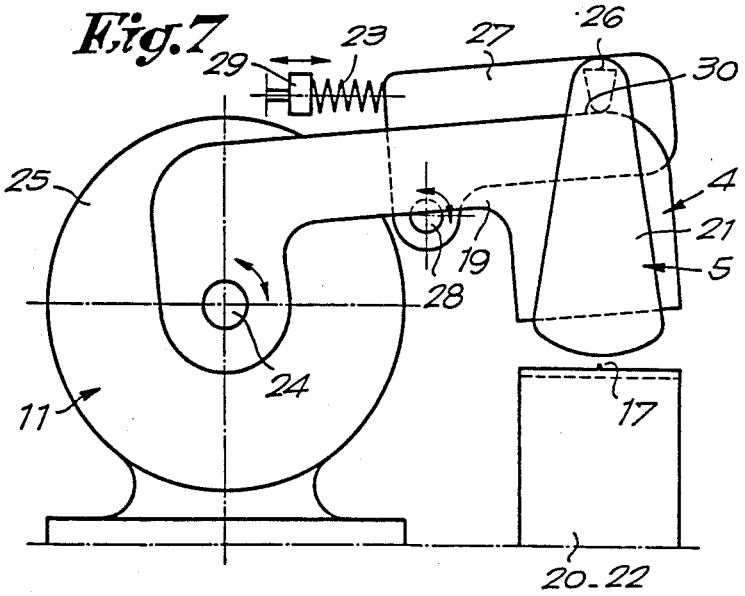
FIG. 7 is a side elevational view of the mechanism shown in FIG. 5 wherein the clamp is in an open position, after a mispick occurred.

FIGS. 5–7 illustrate a practical embodiment of the cutter 4 corresponding in principle to the schematic illustrations set forth in FIGS. 3 and 4. The movable cutter portion 19 takes the form of a lever arm having one end fixedly attached to output shaft 24 of stepper motor 25. The stepper motor 25, as is well known in the art, maybe rotated through a specific angular range of the basis of a predetermined number of input pulses. In order to cut the weft thread 17, output shaft 24 is rotated in a clockwise direction, as illustrated in FIG. 5, to thereby bring the distal end of the lever arm, which forms the cutting edge, across the path of weft thread 17. After cutting, the arm is returned to the position shown in FIG. 5. In that position, the cutting arm is displaced from the stationary cutting portion 20, but the movable clamping portion 21 is in contact with the stationary clamping portion 22 so as to clamp weft thread 17.

The moving clamping portion 21 is fixedly connected to pivoting arm 27 by means of rigid coupling 26. Arm 27 is pivotally attached to shaft 28 so as to pivot with respect to this shaft. Spring 23, having bias force adjusting means 29, urges arm 27 in a clockwise direction about shaft 28 as illustrated in FIG. 5. Although shaft 28 is shown as being laterally displaced from shaft 24, it should be understood that this shft may be coaxial with the output shaft 24 of the stepper motor 25.

As illustrated in FIG. 6, the stationary cutting portion 20 and the stationary clamping portion 22 may be formed as a single, stationary unit. FIG. 6 also illustrated that rigid coupling 26 extends across the path of travel of movable cutting portion 19.

FIG. 7 illustrates the third position of the movable cutting portion 19 in which it causes the movable clamping portion 21 to be displaced from the stationary clamping portion 22 so as to unclamp the weft thread 17. This is achieved by rotating the stepper motor output shaft 24 a specified amount in the counterclockwise direction, as illustrated in FIG. 7, thereby bringing the upper portion of the cutting lever arm into contact with rigid coupling 26. Additional motion in this direction causes the movable clamping portion 21 as well as the arm 27 to pivot about its attachment shaft 28, thereby opening the clamp 5.

An adjustable element 31 may be affixed to the upper edge 30 of the cutting lever arm so as to more precisely adjust the point at which the lever arm contacts the rigid coupling 26. Element 31 may be adjusted upwardly or downwardly with respect to the upper edge 30.

The foregoing description is provided for illustrative purposes only and should not be construed as in any way limiting this invention, the scope of which is defined solely by the appended claims.

What is claimed is:

1. In a loom having a heddle to alternately raise and lower warp threads, weft thread insertion means to insert a weft thread between the warp threads, a reed to beat-up the inserted weft threads and first, main loom drive means, the improved inserted weft thread cutting mechanism comprising:

(a) cutter means to sever the weft thread;

(b) second drive means, completley separate and independent from the first drive means, to drive the weft thread cutter means;

(c) computer means having data input means and output means operatively connected to the second drive means; and, (d) weft thread detection means connected to the data input means to detect an inserted weft thread and to generate a signal to the computer to control the cutter as a result of the weft thread detection.

2. The improved weft thread cutting mechanism of claim 1 wherein the weft thread detection means detects an improperly inserted weft thread, thereby enabling the computer means to suppress the activation of the cutter means.

3. The improved weft thread cutting mechanism of claim 1 wherein the cutter means comprises:

(a) a stationary cutter portion located such that the inserted weft thread bears against the stationary portion; and (b) a movable cutter portion movable between a retracted position and a cutting position with respect to the stationary cutter portion.

4. The improved weft thread cutting mechanism of claim 3 wherein the second drive means comprises a stepper motor having an output shaft connected to the movable cutter portion.

5. The improved weft thread cutting mechanism of claim 1 further comprising weft thread clamping means to clamp the inserted weft thread in its beat-up position wherein the cutter means severs the clamped weft thread.

6. The improved weft thread cutting mechanism of claim 5 further comprising:

(a) means to bias the weft thread clamping means toward its clamping position; and, (b) release means interconnected with the cutter means to move the clamping means to an open position so as to release the weft thread when the cutter means is moved to a predetermined position.

7. The improved weft thread cutting mechanism of claim 5 wherein the weft thread clamping means comprises:

(a) a stationary clamping portion; and, (b) a movable clamping portion, the portions located such that the weft thread is clamped between them in its beat-up position.

8. The improved weft thread cutting mechanism of claim 7 further comprising spring means to bias the movable clamping portion into contact with the stationary clamping portion.

9. The improved weft thread cutting mechanism of claim 8 wherein the cutter means comprises:

(a) a stationary cutter portion located such that the inserted weft thread bears against the stationary portion when clamped by the clamping means; and (b) a movable cutter portion movable between a retracted position and a cutting position with respect to the stationary cutter portion.

10. The improved weft thread cutting mechanism of claim 9 wherein the second drive means comprises a stepper motor having an output shaft connected to the movable cutter portion.

11. The improved weft thread cutting mechanism of claim 10 wherein the movable cutter portion comprises an arm attached at one end to the output shaft of the stepper motor and a thread cutter portion formed on a distal end.

12. The improved weft thread cutting mechanism of claim 11 further comprising attaching means to pivotally attach the movable clamping portion adjacent to the movable cutter arm.

13. The improved weft thread cutting mechanism of claim 12 further comprising a stop means fixedly attached to the movable clamping portion so as to extend into a path of travel of the cutter arm.

14. The improved weft thread cutting mechanism of claim 12 wherein the computer means is connected to the stepper motor so as to activate the stepper motor and move the movable cutter arm between: a first position adjacent the stationary cutter portion so as to sever the inserted weft thread; a second position in which the cutter arm is displaced from the stationary cutter portion, but out of contact with the stop means such that the movable clamping portion is in contact with the stationary clamping portion; and a third position in which the cutting arm contacts the stop means so as to displace the movable clamping portion away from the stationary portion so as to release the weft thread from the clamping means.

15. The improved weft thread cutting mechanism of claim 1 wherein the weft thread detection means detects a correctly inserted weft thread, thereby enabling the computer means to activate the second drive means which activates the cutter means to sever the weft thread.

16. In a loom having a heddle to alternately raise and lower warp threads, weft thread insertion means to insert a weft thread between the warp threads, a reed to beat-up the inserted weft thread and first, main loom drive means, the improved method of cutting the inserted weft thread comprising the steps of:

(a) providing a cutting device to cut the weft thread;

(b) providing a second drive means, completely separate from the first drive means to activate the cutting device;

(c) controlling the second drive means by computer means having data input means and output means connected to the second drive means such that the cutting device operates completely separate from the main loom drive means; and, (d) detecting an inserted weft thread by a weft thread detection means connected to the data input means of the computer and which generates a signal to the computer to control the cutter as a result of the weft thread detection.

17. The improved method of claim 16 comprising the additional step of clamping the weft thread in its beat-up position such that the cutting device cuts the weft thread while clamped.

18. The improved method of claim 17 comprising the additional step of:

(a) detecting an improperly inserted weft thead; and (b) preventing the activation of the cutter in response to the detection of the improperly inserted weft thread.

19. The improved method of claim 18 comprising the further step of unclamping the weft thread following the detection of the improperly inserted weft thread.

20. The improved method of claim 16 comprising the additional step of activiting the cutter in response to the detection of a properly inserted weft thread.

* * * * *